US011459854B2

(12) United States Patent
Zachariah et al.

(10) Patent No.: US 11,459,854 B2
(45) Date of Patent: Oct. 4, 2022

(54) MULTIPLE PORT OPENING METHOD WITH SINGLE PRESSURE ACTIVATION

(71) Applicant: HALLIBURTON ENERGY SERVICES, INC., Houston, TX (US)

(72) Inventors: Jacob Zachariah, Singapore (SG); Maxime Philippe Coffin, Carrollton, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 82 days.

(21) Appl. No.: 16/760,529

(22) PCT Filed: Jun. 25, 2019

(86) PCT No.: PCT/US2019/038905
§ 371 (c)(1),
(2) Date: Apr. 30, 2020

(87) PCT Pub. No.: WO2020/263224
PCT Pub. Date: Dec. 30, 2020

(65) Prior Publication Data

US 2021/0404290 A1 Dec. 30, 2021

(51) Int. Cl.

| | |
|---|---|
| ***E21B 34/08*** | (2006.01) |
| ***E21B 34/10*** | (2006.01) |
| ***E21B 43/12*** | (2006.01) |

(52) U.S. Cl.
CPC ..... *E21B 34/08* (2013.01); *E21B 34/102* (2013.01); *E21B 34/103* (2013.01); *E21B 43/12* (2013.01)

(58) Field of Classification Search
CPC ..... E21B 34/08; E21B 34/103; E21B 34/06; E21B 34/10; E21B 34/063; E21B 21/08; E21B 21/10–106; E21B 21/00; E21B 21/082; E21B 21/085; E21B 23/00; E21B 41/00; E21B 41/0092; E21B 41/0099; E21B 43/12
See application file for complete search history.

(56) References Cited

U.S. PATENT DOCUMENTS

| | | | |
|---|---|---|---|
| 8,474,535 | B2 | 7/2013 | Richards et al. |
| 8,851,190 | B1 | 10/2014 | Lopez |
| 2012/0305243 | A1 | 12/2012 | Hallundaek et al. |
| 2014/0151065 | A1 | 6/2014 | Stephenson et al. |

(Continued)

OTHER PUBLICATIONS

International Search Report and Written Opinion for International application No. PCT/US2019/038905, dated Mar. 24, 2020, 5 pages.

*Primary Examiner* — George S Gray
(74) *Attorney, Agent, or Firm* — Novak Druce Carroll LLP

(57) ABSTRACT

A flow control apparatus with a guide housing having one or ports, a breakable bond, and a platform with an upper surface having one or more pistons. The platform and guide housing have a first bonded configuration where the pistons are received in the ports, a breaking configuration, an opening configuration where the platform is movable away from the guide housing, and a misaligned configuration where the platform is displaced with respect to the guide housing. The guide housing has a guide bore and the platform has a guide projection extending into the guide bore. The guide bore has a groove and the guide projection has an extension extending in the groove for transitioning between configurations.

14 Claims, 6 Drawing Sheets

(56) References Cited

U.S. PATENT DOCUMENTS

| | | | | |
|---|---|---|---|---|
| 2015/0315871 | A1 | 11/2015 | Fripp et al. | |
| 2017/0254174 | A1* | 9/2017 | Least | E21B 34/063 |
| 2018/0328140 | A1 | 11/2018 | Schmidt | |

* cited by examiner

MULTIPLE PORT OPENING METHOD WITH SINGLE PRESSURE ACTIVATION

CROSS-REFERENCE TO RELATED APPLICATIONS

This application is a national stage entry of PCT/US2019/038905 filed Jun. 25, 2019, said application is expressly incorporated herein in its entirety.

FIELD

The present disclosure relates to a flow control apparatus, and in particular a flow control apparatus for use as an autonomous inflow control device for a downhole tubular.

BACKGROUND

During the course of well completion operations, production tubing is provided in a wellbore in order to withdraw hydrocarbons from hydrocarbon bearing formations. Various zones for production along the length of the wellbore may be isolated by the use of packers. In order to control the flow of fluids into the production tubing, autonomous inflow control devices may be employed. These autonomous inflow control devices may be used to regulate the flow of fluids into the production tubing that have migrated to the wellbore from the surrounding formation. The autonomous inflow control device may also permit the flow of hydrocarbons while restricting undesirable fluids such as water.

BRIEF DESCRIPTION OF THE DRAWINGS

In order to describe the manner in which the above-recited and other advantages and features of the disclosure can be obtained, a more particular description of the principles briefly described above will be rendered by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
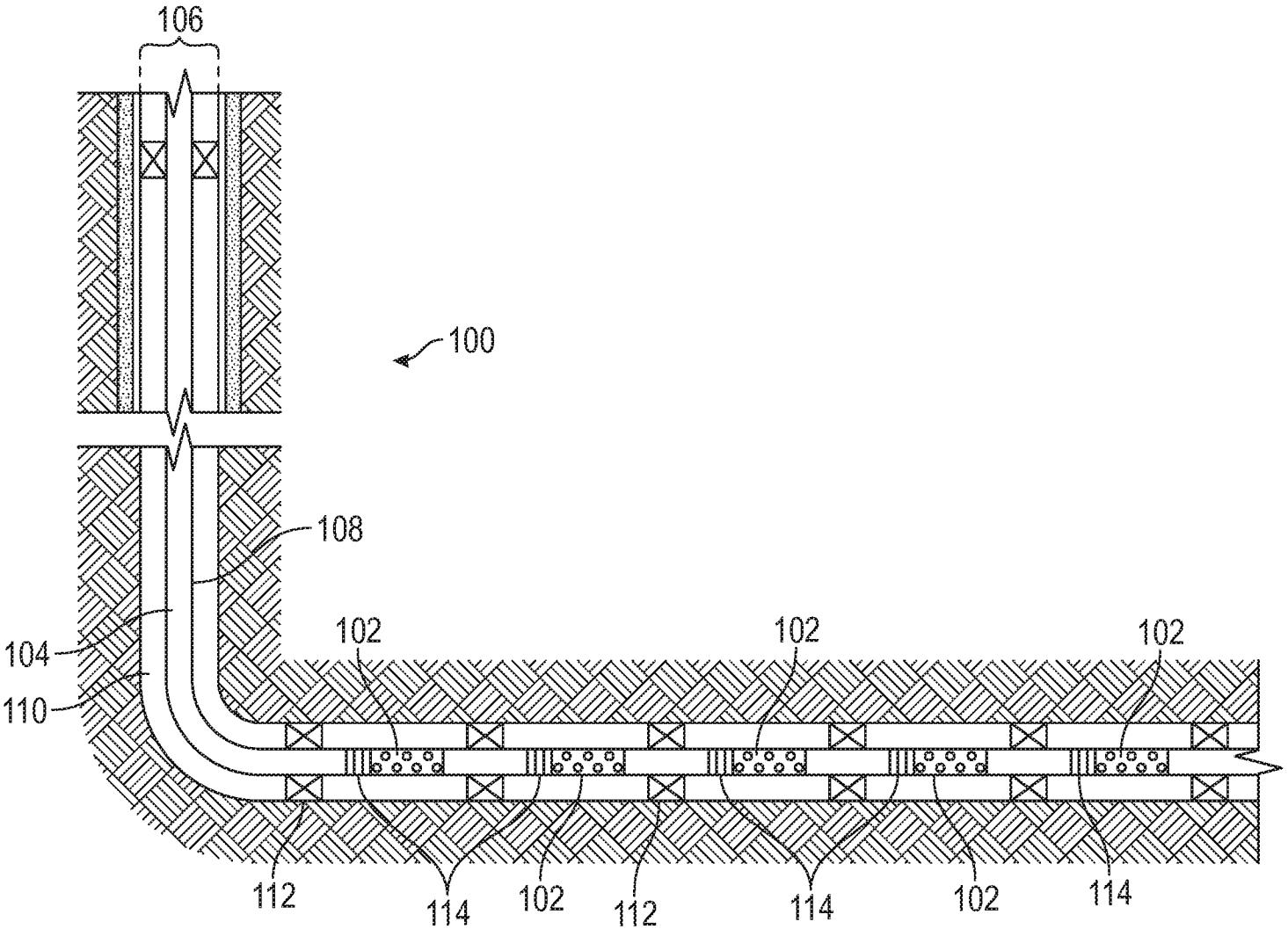
FIG. 1 illustrates a wellbore completion operating environment with a flow control apparatus installed as part of the production tubing, according to the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure. Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Various control devices, such as an autonomous inflow control device, are employed with production tubing in a wellbore to create a low restriction flow path for fluids in both directions. During completion operations production tubing may be run into a wellbore to a desired location. In order to perform certain operations, such as setting a packer, it may be of interest to seal the production tubing until the operation is complete. Once complete, flow into the production tubing may be desirable.

Disclosed herein is a flow control apparatus which may be located within the wall of a tubular, the flow control apparatus having multiple configurations to initially seal the tubular, so that it may be run downhole, permitting one or more operations, such as setting one or more packers, and then permitting inflow of fluid from the annular area and the surrounding formation into the tubular. The flow control apparatus may also be incorporated with any other products as a mechanism to provide for the opening of one or more ports with pressure.

The flow control apparatus may have a guide housing with a plurality of ports, and a platform with a plurality of pistons. In a first configuration, the plurality of pistons may be positioned within the plurality of ports to fluidically seal them, thereby preventing the flow of fluid from to the annular area into the tubular. A bond, such as a sealant, may be employed to restrain movement from this first configuration. Upon an increase in pressure from within the tubular, the flow control apparatus is placed in a breaking configuration where the bond may be broken. In particular, upon a predetermined pressure from within the tubular, the platform may be moveable a distance axially toward the guide housing (upward radially away from middle of the tubular), thereby breaking the bond. This increase in pressure may be activated by operators at the surface to activate breaking of the bond, and/or to carry out an operation requiring pressurization within the tubular, such as setting a packer. During this breaking configuration, flow from the annular area is still prevented by the flow control apparatus.

After breaking the bond, and performing any operations requiring pressure within the tubular, the flow control apparatus can then be reconfigured to an opening configuration to permit flow of fluid within the annular area. Namely, as pressure within the tubular is reduced, or pressure in the annular area builds up, a pressure differential is formed with lower pressure within the tubular as compared to the annular area. As a result of this pressure change, the ports are withdrawn from the pistons by way of the platform being moved away from the guide housing, thereby fluidically opening the plurality of ports. Thereafter, the flow control apparatus can be locked in its open configuration. The guide housing may have grooves which cause the platform to be withdrawn from the guide housing through a twisting motion. The twisting motion can be achieved by an energized spring, pen twist mechanism with a spring, or a pen twist mechanism without a spring (e.g., j-slot). As a result of the twisting, the plurality of pistons becomes misaligned with the plurality of ports of the guide housing. In this configuration, the ends of the plurality of pistons of the platform may be at the bottom portion of the guide housing. This misalignment causes the flow control apparatus to remain open.

FIG. 1 illustrates a wellbore completion operating environment 100 with a flow control apparatus 102 installed as part of the production tubing 104 according to the present disclosure. As depicted in FIG. 1, the operating environment includes a wellbore 106 that penetrates a subterranean formation. The wellbore 106 may be drilled into the subterranean formation using any suitable drilling technique. The wellbore 106 may extend substantially vertically away from the Earth's surface as shown or in alternative operating environments; portions or substantially all of the wellbore may be vertical, deviated, horizontal, and/or curved. Although the illustrated example shows production tubing 104, the flow control apparatus may be employed with any suitable downhole tubular, including coiled tubing, segmented tubing string, jointed tubing string, or any other suitable conveyance, or combinations thereof. The production tubing 104 extends within the wellbore forming an annular area 110 between the external surface of the production tubing 104 and the walls 108 of the wellbore 106 which may have a casing cemented thereon. The production tubing 104 may include screens 114 which may prevent the inflow of undesirable solids or particles, such as sand.

As further shown in FIG. 1, a flow control apparatus 102 may be embedded in the wall 108 of the production tubing 104. The production tubing 104 provides a conduit for formation fluids to travel from formation to the surface. The flow control apparatus 102 has flow ports which may be sealed or unsealed to permit or restrict flow. The flow control apparatus 102 may be fixed in the wall 108 of the production tubing 104, directly on a base pipe 116, or can be incorporated into any other part of the device. In the annular area 110 around the production tubing 104, packers 112 may be used to isolate one formation from another. The production tubing 104 may be any kind of downhole tubular, such as a production tubular, a casing, coiled tubing, or joint of a drill string. One or more screens 114 may be arranged around the base pipe 116.

Figure 2:
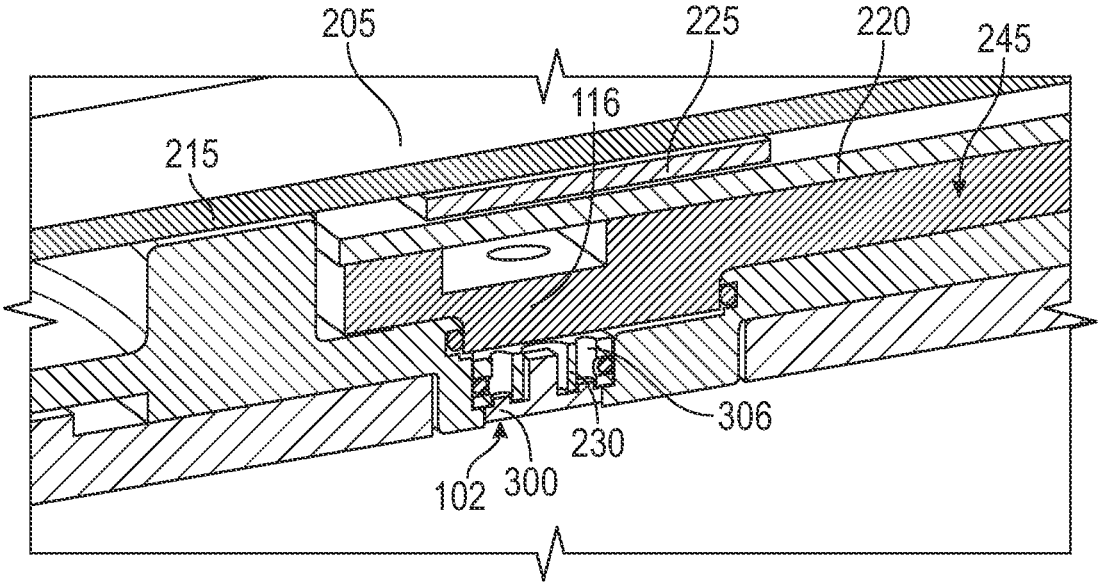
FIG. 2 illustrates a schematic view of a flow control apparatus in a first bonded configuration provided within the wall of a tubular, according to the present disclosure.

FIG. 2 is a schematic view of a flow control apparatus 102 in a first bonded configuration provided within the wall 205 of a production tubing 104. The wall 205 may be a single wall, or alternatively have an external layer 215, an internal layer 220, with a supporting midlayer 225. The flow control apparatus 102 may be provided in a port 230, which provides a fluidic communication into or out of the inner bore 245 of the production tubing 104. The base pipe 116 defines an internal flow passageway that forms a portion of the interior of the production tubing 104. Fluid may enter the flow control apparatus 102 and be discharged into the base pipe 116 through the flow ports 306 when they are permanently opened. In some instances, fluid can be restricted from entering the base pipe 116 by closing the flow ports 306.

Figure 3:
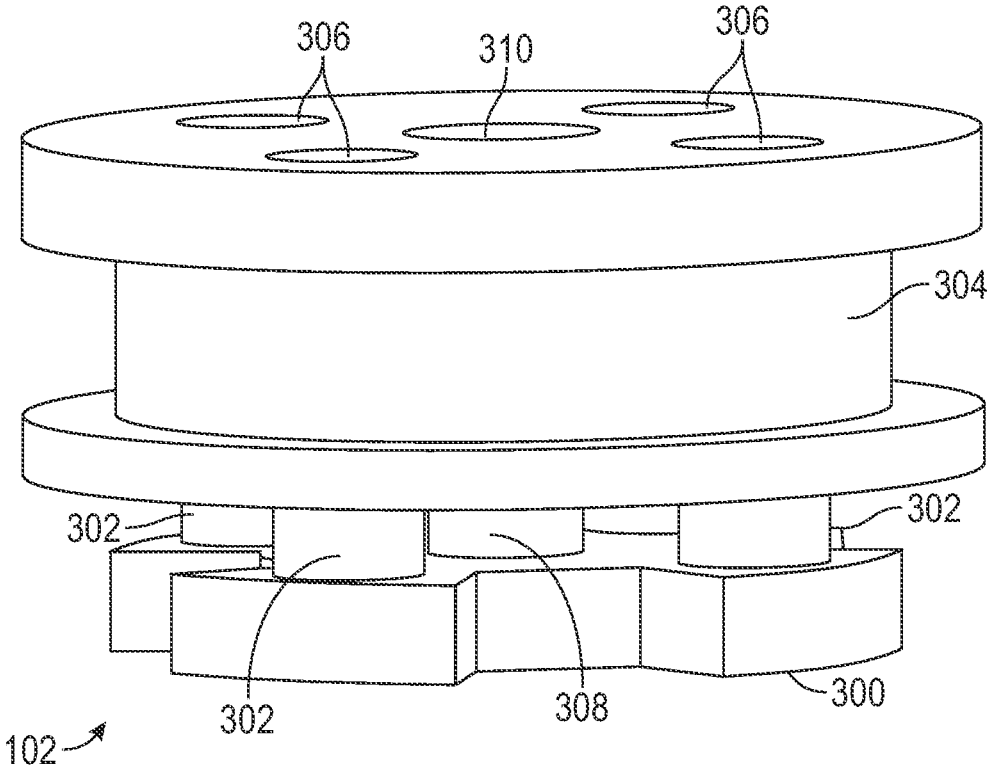
FIG. 3 illustrates a schematic view of the flow control apparatus in a first bonded configuration, according to the present disclosure.

FIG. 3 is a schematic view of the flow control apparatus 102 in the first bonded configuration, wherein fluidic communication through the flow control apparatus 102 is prevented. As illustrated, the platform 300 has a plurality of pistons 302 attached thereto, the guide housing 304 has a plurality of ports 306 which receive the pistons 302. While four pistons 302 and four ports 30 are shown, one or more, or a plurality of pistons 302 and ports 306 may be employed, such as one to ten, two to eight, or four to six, or any combination of the aforementioned, however the same number of corresponding pistons 302 and ports 306 are to be employed. The platform 300 also has a guide projection 308 which is used with the guide bore 310 on the guide housing 304 to transition the platform 300 toward and away from the guide housing 304. The apparatus can replace all shear plugs (e.g., mirage plugs) or any other burst/temporary plug in various quantities at various temperatures. The apparatus can achieve activation or opening or multiple ports. High pressure from the opposite side of the platform 300 will push the platform 300 away from the housing 304. Shear pins, snap rings, Loctite, any metal to metal surface seal, any elastomers, or any other sealant can be used to prevent the pistons from being displaced prematurely.

Figure 4:
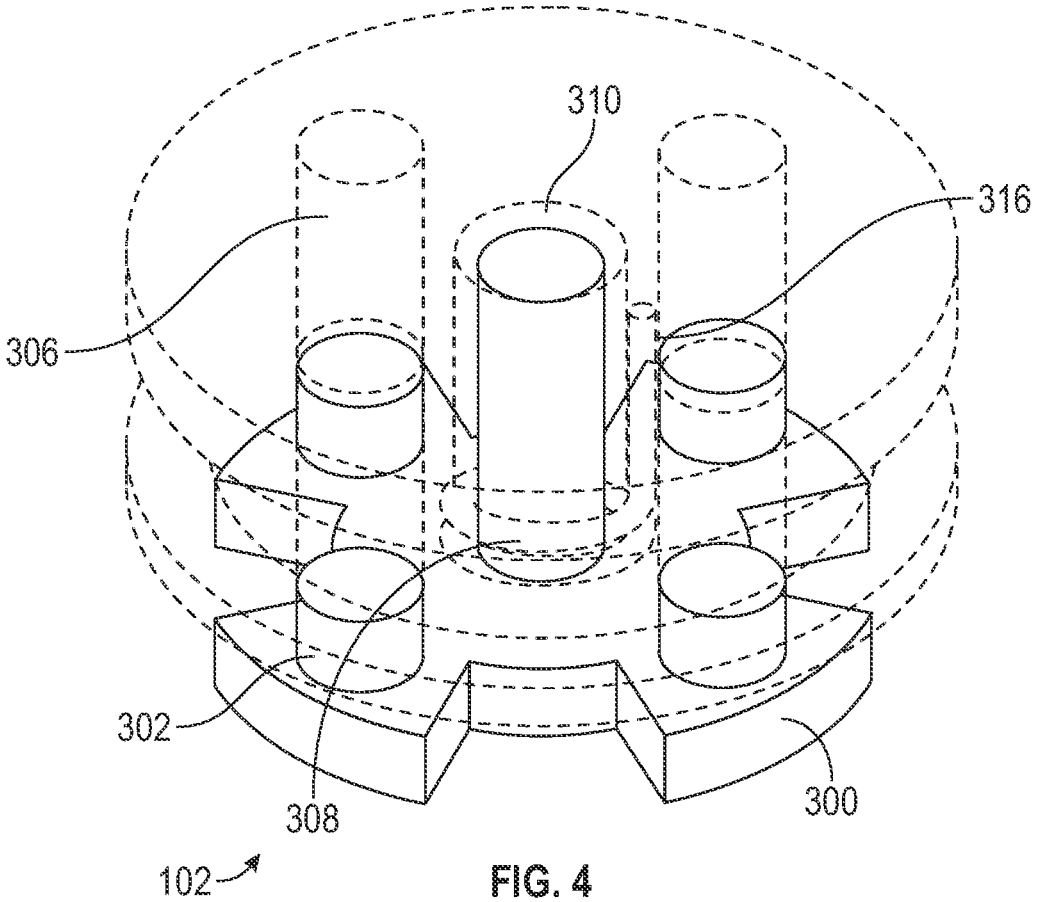
FIG. 4 illustrates a perspective view of the flow control apparatus in a first bonded configuration, according to the present disclosure.

FIG. 4 illustrates a perspective view of the flow control apparatus 102 in a first bonded configuration. In addition to the pistons 302 and ports 306, a spiral groove 316 may be provided to permit the twisting movement of the guide projection 308 with respect to the guide bore 310. The spiral groove 316 will be located on the guide bore 310 and an extension 314 will be located on the guide projection 308 to track the spiral groove 316 on the guide bore 310. The guide bore 310 may be modified based on the need to dictate the movement of the guide projection 308 and the platform 300.

Figure 5:
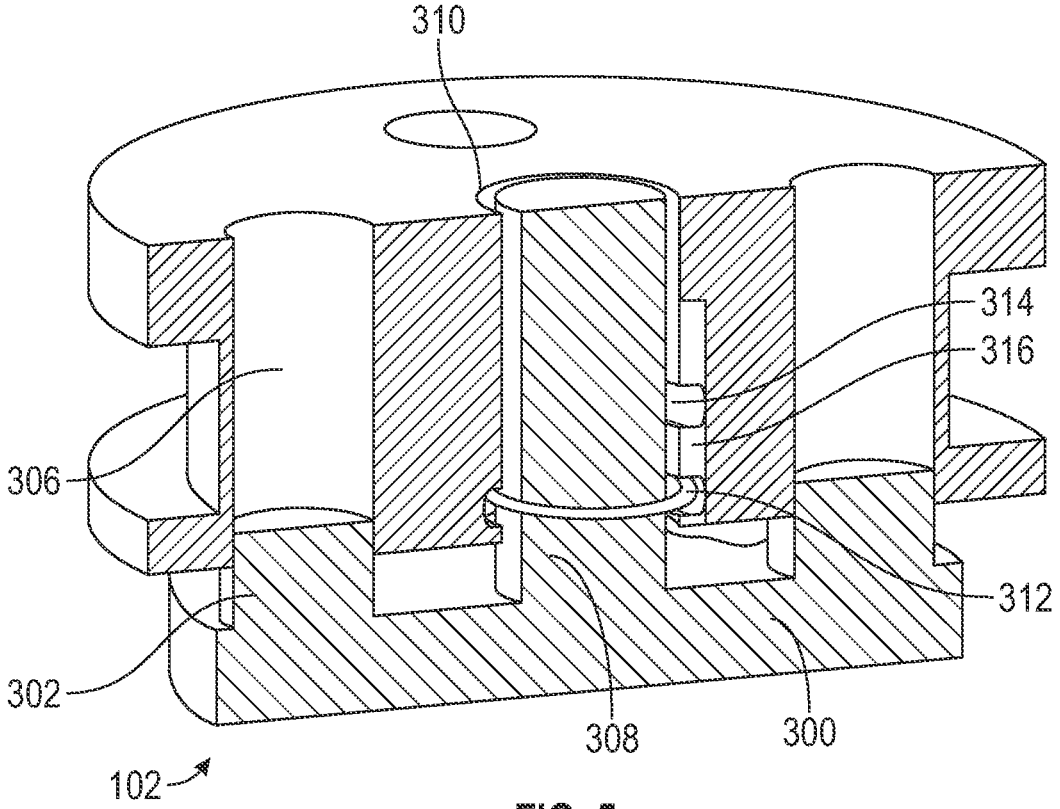
FIG. 5 illustrates a section view of the flow control apparatus in a first bonded configuration, according to the present disclosure.

FIG. 5 illustrates a section view of the flow control apparatus 102 in the first bonded configuration. As shown a bond 312 is formed between the extension 314 of the guide projection 308 and the guide bore 310. Breaking of the bonds 312 leads to movement of the guide bore 310 and pistons 302 away from the guide projection 308 and ports 306. The movement continues until a predetermined maximum position is achieved where the guide projection 308 is still partially inside the guide bore 310 and the extension 314 is on the end of the spiral grooves 316. While the bond 312 is shown as wire in FIG. 5, it may also be an adhesive or sealant.

The sealed condition of the flow control apparatus 102 allows for pressure to build up in the opposite direction of the platform 300. The bond 312 remains intact until the pressure reaches a predetermined threshold and shears or otherwise breaks the bond 312. The breaking of the bond 312 moves the platform 300 away from the guide housing 304 to create an opening in ports 306 as the pistons 302 are withdrawn.

Figure 6:
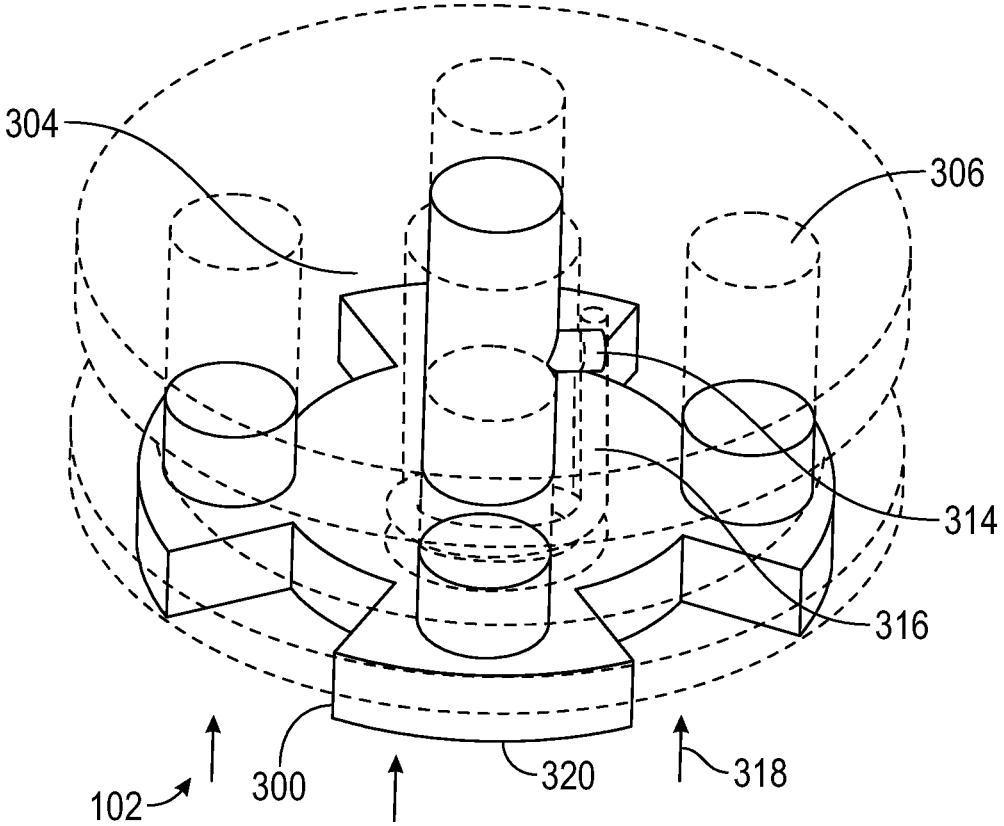
FIG. 6 illustrates the flow control apparatus in a breaking configuration, according to the present disclosure.

FIG. 6 illustrates the flow control apparatus 102 in a breaking configuration. As shown by the arrows 318, as pressure is exerted and experienced on the lower surface 320 of the platform 300 the bond 312 is broken. This has the effect of permitting upward movement of the platform 300 toward the guide housing 304. In this configuration, the flow control apparatus is still sealed, preventing fluidic communication through ports 306. This permits pressure from within the production tubing 104 to be increased without passing into the annular area 110 (annular area 110 in FIG.

1). This also facilitates any downhole operation requiring pressure within the tubular, such as activating and pressurizing packers 112.

Figure 7:
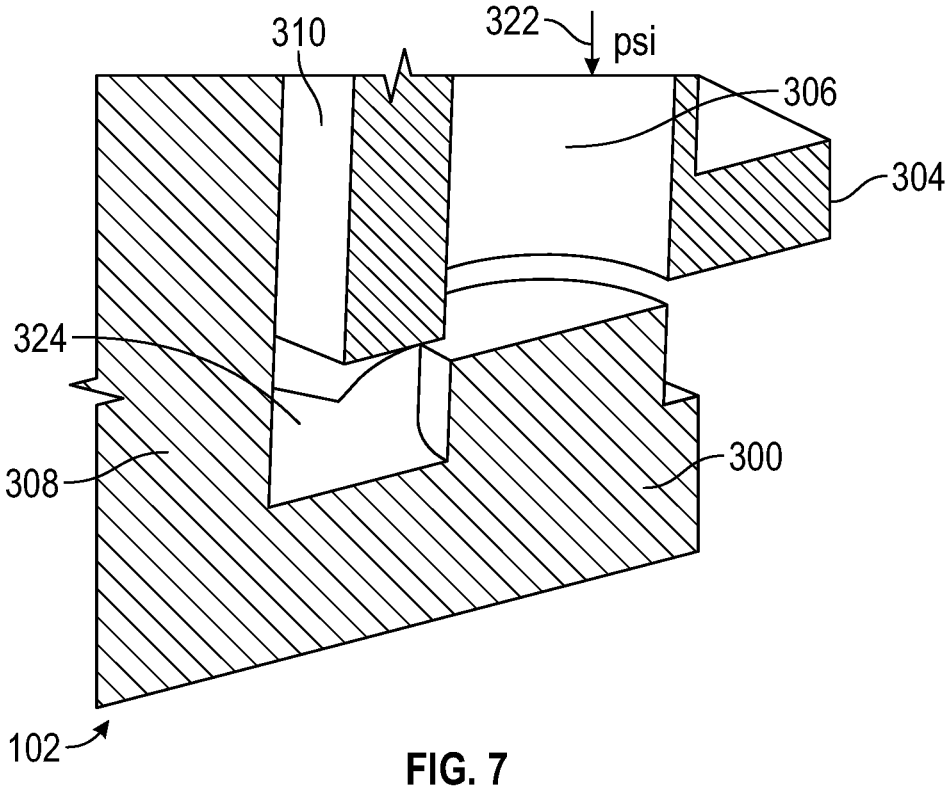
FIG. 7 illustrates the flow control apparatus in an opening configuration, according to the present disclosure.

FIG. 7 illustrates the flow control apparatus 102 in an opening configuration. As shown by the arrow 322, fluid is provided from the annular area 110 through the ports 306 against the pistons 304 and the platform 300. As this force is experienced by the upper surface of the platform 324, the platform 300 is shifted away from the guide housing 304 by virtue of the twisting movement of the guide projection 308 with respect to the guide bore 310. The platform 300 will be displaced from the guide housing 304 and the guide projection 308 will continue to experience the twisting movement with respect to the guide bore 310 until it reaches a predetermined maximum position.

Figure 8:
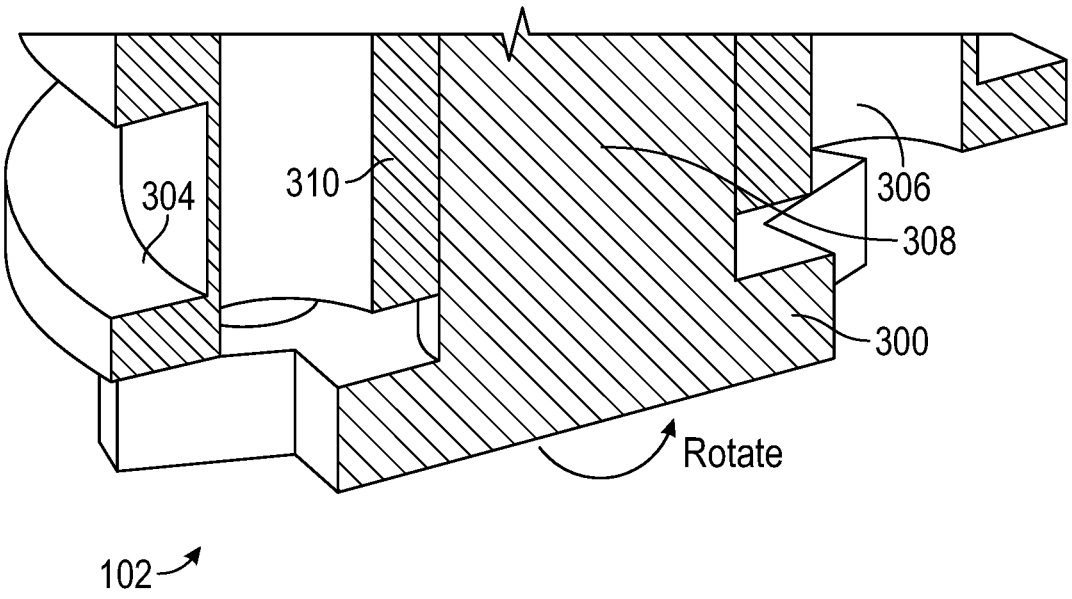
FIG. 8 illustrates the rotation of the flow control apparatus to the misaligned configuration, according to the present disclosure.

FIG. 8 illustrates the rotation of the flow control apparatus 102 to the misaligned configuration. This has the effect of leading to a permanent opening of the flow ports 306, where the pistons 302 are displaced from the flow ports 306. The spiral grooves 316 in the guide bore 310 allow for rotation of the platform 300 with respect to the guide housing 304 to create an opening. The extension 314 on the guide projection 308 tracks the grooves 316 on the guide bore 310. Further, in this configuration, the pressure in the production tubing 104 is maintained and increases until all flow ports 306 are opened. Once the flow ports 306 are opened, the pressure releases and pressure and flow from the opposite direction creates a permanent opening.

Figure 9:
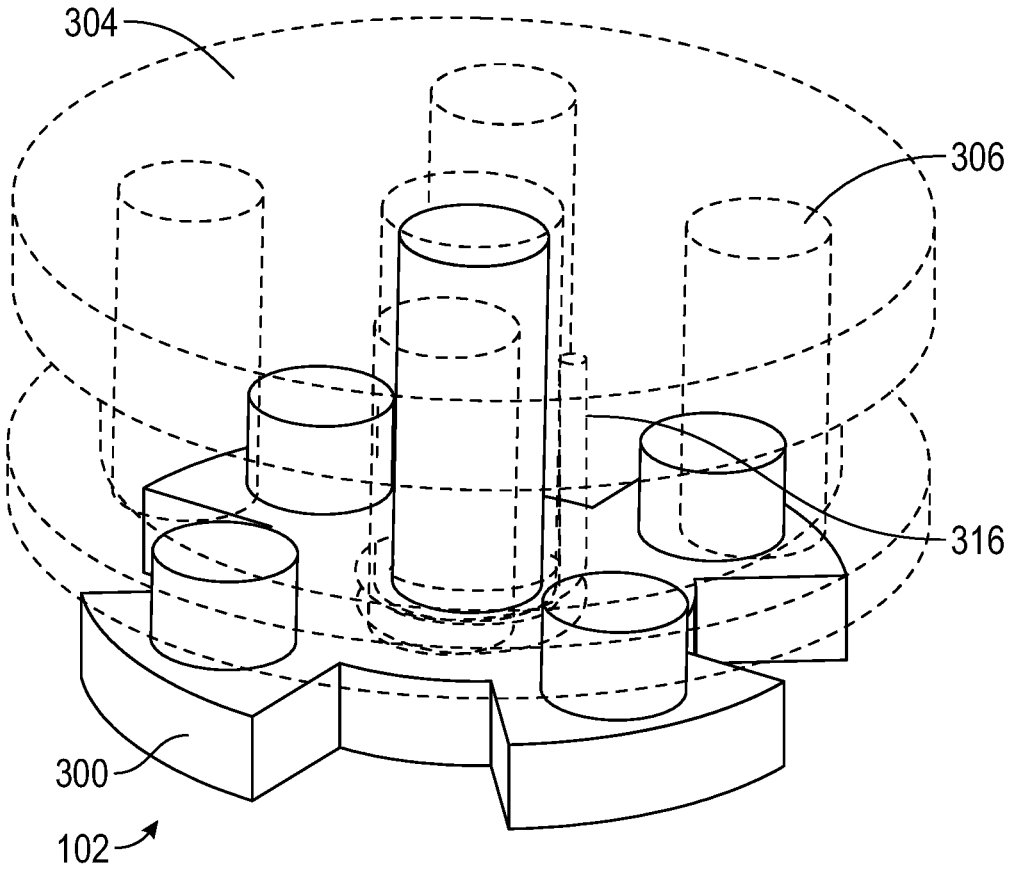
FIG. 9 illustrates the flow control apparatus in a misaligned configuration, according to the present disclosure.

FIG. 9 illustrates the flow control apparatus 102 in a misaligned configuration in which the platform 300 is displaced with respect to the guide housing 304. In order to move from the first bonded configuration to the misaligned configuration in the platform 300 will have to first transition from a breaking configuration to an opening configuration. The platform 300 will move a predetermined distance corresponding to a predetermined pressure and will continue to do so until it reaches a predetermined maximum position. The opening configuration initiates the fluidic opening of the flow ports 306. The pressure must build up to a predetermined pressure for all bonds 312 to be broken. All of the bonds 312 must be broken for the flow ports 306 to become open. The flow ports 306 will stay in the open position permanently and any future sealing of the flow port 306 is avoided by way of the twisting mechanism. As a result, the single pressure used to activate one port can be used to activate multiple flow ports 306. This is due to the internal pressure being intact and not lost when the flow ports 306 are first opened.

Figure 10:
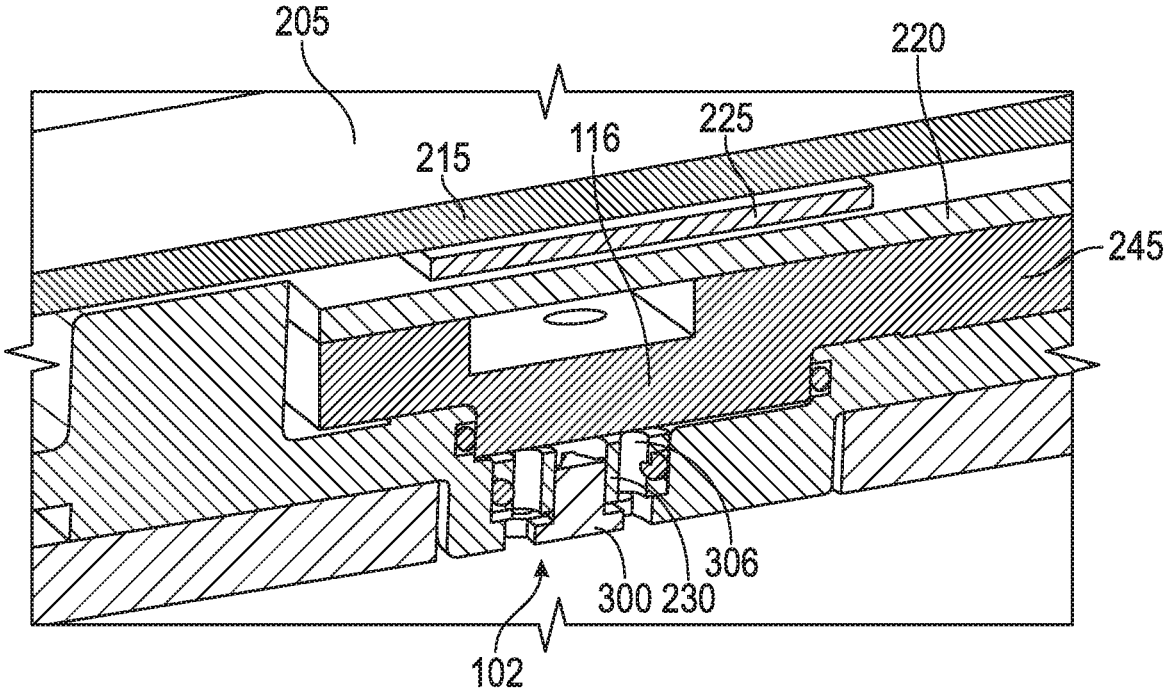
FIG. 10 illustrates the flow control apparatus provided in the wall of a tubular in a misaligned configuration, according to the present disclosure.

FIG. 10 illustrates the flow control apparatus 102 provided in the wall 205 of a production tubing 104 in the misaligned configuration. The pressure in the production tubing 104 breaks the bond 312 and the platform 300 moves outward to a predetermined maximum position. The production tubing 104 pressure remains intact until the bonds 312 on all of the remaining flow ports 306 are broken. Once all of the bonds 312 are broken, the pressure in the production tubing 104 can be reduced. This will allow the other end pressure to push the platform 300 and cause the opening of all of the ports 306.

Statements of the disclosure include:

Statement 1: A flow control apparatus comprising a guide housing having one or more ports extending therethrough; a breakable bond; and a platform having a lower surface and an upper surface, one or more pistons extending from the upper surface, the platform transitionable from a first bonded configuration wherein the one or more pistons are at least partially received in the one or more ports of the guide housing, thereby fluidically sealing the one or more ports, the platform being restrained from movement relative the guide housing by the breakable bond, to a breaking configuration wherein the platform is moveable a predetermined distance axially with respect to the height of the piston toward the guide housing upon experiencing a predetermined pressure upon the lower surface of the platform sufficient to break the breakable bond, thereafter to an opening configuration wherein the platform is moved a second predetermined distance axially with respect to the height of the piston away from the guide housing and the one or more pistons are displaced from the one or more ports upon experiencing a second predetermined pressure upon the upper surface of the platform, thereby fluidically opening the one or more ports, and thereafter to a misaligned configuration wherein the platform is displaced with respect to the guide housing.

Statement 2: A flow control apparatus according to Statement 1, wherein in the misaligned configuration the ports are permanently fluidically opened.

Statement 3: A flow control apparatus according to any of Statements 1 and 2, wherein the guide housing has a guide bore, the platform has a guide projection, the guide projection extending into the guide bore in the first bonded configuration.

Statement 4: A flow control apparatus according to any of Statements 1 through 3, the guide bore has a groove, and the guide projection has an extension extending into the groove for transitioning between the opening configuration and the misaligned configuration.

Statement 5: A flow control apparatus according to any of Statements 1 through 4, the groove and the extension extending into the groove causes a twisting motion of the platform when transitioning between the opening configuration and the misaligned configuration.

Statement 6: A flow control apparatus according to any of Statements 1 through 5, wherein the breakable bond is one or more of a shear pin, set pin, adhesive, and/or a combination thereof.

Statement 7: A method for opening a plurality of ports comprising embedding one or more flow control devices in a tubular, wherein the flow control devices comprises a guide housing having one or more ports extending therethrough, a breakable bond, and a platform having a lower surface and an upper surface, one or more pistons extending from the upper surface, applying a predetermined pressure within the tubular; breaking a bond on the guide housing and the platform with the one or more pistons of the one or more flow control device; moving the platform away from the guide housing axially with respect to the height of the piston; moving the piston to a predetermined maximum position; and allowing the predetermined pressure to build up to a threshold.

Statement 8: A method according to Statement 7, wherein allowing the predetermined pressure to build up to a threshold causes the one or more flow control device to become permanently fluidically opened.

Statement 9: A system comprising a tubular disposed in a wellbore, the tubular having a wall and an inner bore; an inflow control device embedded in the wall of the tubular, the inflow control device comprising a guide housing having one or more ports extending therethrough; a breakable bond; and a platform having a lower surface and an upper surface, one or more pistons extending from the upper surface, the platform transitionable from a first bonded configuration wherein the one or more pistons are at least partially received in the one or more ports of the guide housing, thereby fluidically sealing the one or more ports, the platform being restrained from movement relative the guide housing by the breakable bond, to a breaking configuration wherein the platform is moveable a predetermined distance axially with respect to the height of the piston toward the guide housing upon experiencing a predetermined pressure upon the lower surface of the platform sufficient to break the breakable bond, thereafter to an opening configuration wherein the platform is moved a second predetermined distance axially with respect to the height of the piston away from the guide housing and the one or more pistons are displaced from the one or more ports upon experiencing a second predetermined pressure upon the upper surface of the platform, thereby fluidically opening the one or more ports, and thereafter to a misaligned configuration wherein the platform is displaced with respect to the guide housing.

Statement 10: A system according to Statement 9, wherein the misaligned configuration are permanently fluidically opened.

Statement 11: A system according to any of Statements 9 through 10, wherein the guide housing has a guide bore, the platform has a guide projection, the guide projection extending into the guide bore in the first bonded configuration.

Statement 12: A system according to any of Statements 9 through 11, the guide bore has a groove, and the guide projection has an extension extending into the groove for transitioning between the opening configuration to the misaligned configuration.

Statement 13: A system according to any of Statements 9 through 12, the groove and the extension extending into the groove causes a twisting motion of the platform when transitioning between the opening configuration to the misaligned configuration.

Statement 14: A system according to any of Statements 9 through 13, wherein the breakable bond is one or more of a shear pin, set pin, adhesive, and/or a combination thereof.

While the foregoing is directed to embodiments of the present invention, other and further embodiments of the invention may be devised without departing from the basic scope thereof, and the scope thereof is determined by the claims that follow. Those skilled in the art, having the benefit of this disclosure, will appreciate numerous modifications and variations therefrom. It is intended that the appended claims cover all such modifications and variations as fall within the true spirit and scope of this present invention.

What is claimed is:

1. A flow control apparatus comprising:

a guide housing having one or more ports extending therethrough and a guide bore;

a breakable bond; and a platform having a lower surface and an upper surface, one or more pistons extending from the upper surface, and a guide projection extending into the guide bore in a first bonded configuration, the breakable bond being between the guide housing and the guide projection, the platform transitionable from the first bonded configuration wherein the one or more pistons are at least partially received in the one or more ports of the guide housing, thereby fluidically sealing the one or more ports, the platform being restrained from movement relative the guide housing by the breakable bond, to a breaking configuration wherein the platform is moveable a predetermined distance axially with respect to the height of the piston toward the guide housing upon experiencing a predetermined pressure upon the lower surface of the platform sufficient to break the breakable bond, thereafter to an opening configuration wherein the platform is moved a second predetermined distance axially with respect to the height of the piston away from the guide housing and the one or more pistons are displaced from the one or more ports upon experiencing a second predetermined pressure upon the upper surface of the platform, thereby fluidically opening the one or more ports, and thereafter to a misaligned configuration wherein the platform is displaced with respect to the guide housing and wherein the one or more pistons are misaligned with respect to the one or more ports.

2. The flow control apparatus of claim 1, wherein in the misaligned configuration the one or more ports are permanently fluidically opened.

3. The flow control apparatus of claim 1, wherein the guide bore has a j-slot.

4. The flow control apparatus of claim 1, the guide bore has a groove, and the guide projection has an extension extending into the groove for transitioning between the opening configuration and the misaligned configuration.

5. The flow control apparatus of claim 4, the groove and the extension extending into the groove causes a twisting motion of the platform when transitioning between the opening configuration and the misaligned configuration.

6. The flow control apparatus of claim 1, wherein the breakable bond is one or more of a shear pin, set pin, adhesive, and/or a combination thereof.

7. A method for opening a plurality of ports comprising:

(a) embedding one or more flow control devices in a tubular, wherein the one or more flow control devices each comprise a guide housing having one or more ports of the plurality of ports extending therethrough and a guide bore, a breakable bond, and a platform having a lower surface and an upper surface, one or more pistons extending from the upper surface, and a guide projection extending into the guide bore, the breakable bond being between the guide housing and the guide projection, the platform transitionable from a first bonded configuration wherein the one or more pistons are at least partially received in the one or more ports of the guide housing, thereby fluidically sealing the one or more ports, the platform being restrained from movement relative the guide housing by the breakable bond, to a breaking configuration wherein the platform is moveable a predetermined distance axially with respect to the height of the piston toward the guide housing upon experiencing a predetermined pressure upon the lower surface of the platform sufficient to break the breakable bond, thereafter to an opening configuration wherein the platform is moved a second predetermined distance axially with respect to the height of the piston away from the guide housing and the one or more pistons are displaced from the one or more ports upon experiencing a second predetermined pressure upon the upper surface of the platform, thereby fluidically opening the one or more ports, and thereafter to a misaligned configuration wherein the platform is displaced with respect to the guide housing and wherein the one or more pistons are misaligned with respect to the one or more ports, (b) applying a predetermined pressure within the tubular;

(c) breaking the breakable bond on the guide housing and the platform with the one or more pistons of the one or more flow control device;

(d) moving the platform away from the guide housing axially with respect to the height of the piston;

(e) moving the piston to a predetermined maximum position; and (f) allowing the predetermined pressure to build up to a threshold.

8. The method of claim 7, wherein allowing a second predetermined pressure to build up to a threshold causes the one or more flow control device to become permanently fluidically opened.

9. A system comprising:

a tubular disposed in a wellbore, the tubular having a wall and an inner bore;

an inflow control device embedded in the wall of the tubular, the inflow control device comprising:

a guide housing having one or more ports extending therethrough and a guide bore;

a breakable bond; and a platform having a lower surface and an upper surface, one or more pistons extending from the upper surface, and a projection extending into the guide bore in a first bonded configuration, the breakable bond being between the guide housing and the guide projection, the platform transitionable from the first bonded configuration wherein the one or more pistons are at least partially received in the one or more ports of the guide housing, thereby fluidically sealing the one or more ports, the platform being restrained from movement relative the guide housing by the breakable bond, to a breaking configuration wherein the platform is moveable a predetermined distance axially with respect to the height of the piston toward the guide housing upon experiencing a predetermined pressure upon the lower surface of the platform sufficient to break the breakable bond, thereafter to an opening configuration wherein the platform is moved a second predetermined distance axially with respect to the height of the piston away from the guide housing and the one or more pistons are displaced from the one or more ports upon experiencing a second predetermined pressure upon the upper surface of the platform, thereby fluidically opening the one or more ports, and thereafter to a misaligned configuration wherein the platform is displaced with respect to the guide housing and wherein the one or more pistons are misaligned with respect to the one or more ports.

10. The system of claim 9, wherein in the misaligned configuration the one or more ports are permanently fluidically opened.

11. The system of claim 9, wherein the guide bore has a j-slot.

12. The system of claim 9, the guide bore has a groove, and the guide projection has an extension extending into the groove for transitioning between the opening configuration to the misaligned configuration.

13. The system of claim 12, the groove and the extension extending into the groove causes a twisting motion of the platform when transitioning between the opening configuration to the misaligned configuration.

14. The system of claim 9, wherein the breakable bond is one or more of a shear pin, set pin, adhesive, and/or a combination thereof.

* * * * *